US008958582B2

(12) United States Patent
Yoo et al.

(10) Patent No.: US 8,958,582 B2
(45) Date of Patent: Feb. 17, 2015

(54) APPARATUS AND METHOD OF REPRODUCING SURROUND WAVE FIELD USING WAVE FIELD SYNTHESIS BASED ON SPEAKER ARRAY

(75) Inventors: Jae Hyoun Yoo, Daejeon (KR); Hyun Joo Chung, Seoul (KR); Sang Bae Chon, Seoul (KR); Jeong Il Seo, Daejeon (KR); Kyeong Ok Kang, Daejeon (KR); Koang Mo Sung, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 546 days.

(21) Appl. No.: 13/289,316

(22) Filed: Nov. 4, 2011

(65) Prior Publication Data

US 2012/0114153 A1 May 10, 2012

(30) Foreign Application Priority Data

Nov. 10, 2010 (KR) ..... 10-2010-0111529

(51) Int. Cl.

| | |
|---|---|
| ***H04R 5/02*** | (2006.01) |
| ***H04S 7/00*** | (2006.01) |
| *H04R 5/00* | (2006.01) |

(52) U.S. Cl.

CPC ..... *H04S 7/30* (2013.01); *H04S 2400/09* (2013.01); *H04S 2400/11* (2013.01); *H04S 2420/13* (2013.01)

USPC ..... 381/303; 381/17

(58) Field of Classification Search

CPC ..... H04S 3/00; H04S 3/002; H04S 5/00; H04S 2203/12; H04R 3/12; H04R 2205/24

USPC ..... 381/303, 310, 307, 18, 17, 22, 23, 98, 381/63, 312; 700/94

See application file for complete search history.

(56) References Cited

U.S. PATENT DOCUMENTS 8,379,868 B2 * 2/2013 Goodwin et al. ..... 381/17

FOREIGN PATENT DOCUMENTS

| | | |
|---|---|---|
| KR | 10-2009-0026009 | 3/2009 |
| KR | 10-2010-0062773 | 6/2010 |

* cited by examiner

*Primary Examiner* — Vivian Chin
*Assistant Examiner* — Ammar Hamid
(74) *Attorney, Agent, or Firm* — Staas & Halsey LLP

(57) ABSTRACT

Disclosed are an apparatus and method of surround wave field synthesizing a multi-channel signal excluding sound image localization information. A wave field synthesis and reproduction apparatus may include a signal classification unit to classify an inputted multi-channel signal into a primary signal and an ambient signal, a sound image localization information estimation unit to estimate sound image localization information of the primary signal and sound image localization information of the ambient signal, and a rendering unit to render the primary signal and the ambient signal based on the sound image localization information of the primary signal, the sound image localization information of the ambient signal, and listener environment information.

17 Claims, 3 Drawing Sheets

APPARATUS AND METHOD OF REPRODUCING SURROUND WAVE FIELD USING WAVE FIELD SYNTHESIS BASED ON SPEAKER ARRAY

CROSS-REFERENCE TO RELATED APPLICATION

This application claims the priority benefit of Korean Patent Application No. 10-2010-0111529, filed on Nov. 10, 2010, in the Korean Intellectual Property Office, the disclosure of which is incorporated herein by reference.

BACKGROUND

1. Field

Example embodiments relate to an apparatus and method of synthesizing and reproducing a surround wave field, and more particularly, relate to an apparatus and method of surround wave field synthesizing a multi-channel signal excluding sound image localization information.

2. Description of the Related Art

A wave field synthesis and reproduction scheme may correspond to a technology capable of providing the same sound field to several listeners in a listening space by plane-wave reproducing a sound source to be reproduced.

However, to process a sound field signal by the wave field synthesis and reproduction scheme, a sound source signal and sound image localization information about the way of localizing the source signal in the listening space may be used. Thus, the wave field synthesis and reproduction scheme may be difficult to be applied to a mixed discrete multi-channel signal excluding the sound image localization information.

A scheme of performing a wave field synthesis rendering by considering each channel of a multi-channel signal, such as a 5.1 channel, as a sound source, and by considering the sound image localization information using information about an angle of a speaker configuration has been developed. However, the scheme has a problem of causing an unintended wave field distortion phenomenon, and may not achieve an unrestricted sound image localization that is a merit of a wave field synthesis scheme.

Accordingly, a scheme capable of performing the wave field synthesis rendering in the discrete multi-channel signal without the wave field distortion phenomenon is desired.

SUMMARY

The present invention may provide an apparatus and method of minimizing a distortion with respect to sound field information by classifying a multi-channel signal into a primary signal and an ambient signal and reproducing the classified signals.

The foregoing and/or other aspects are achieved by providing a wave field synthesis and reproduction apparatus including a signal classification unit to classify an inputted multi-channel signal into a primary signal and an ambient signal, a sound image localization information estimation unit to estimate sound image localization information indicating a localization of the primary signal and sound image localization information indicating a localization of the ambient signal, and a rendering unit to render the primary signal and the ambient signal based on the sound image localization information of the primary signal, the sound image localization information of the ambient signal, and listener environment information.

When the direction information and the sound image localization information of the primary signal indicate the same direction, the rendering unit may render the primary signal using a wave field synthesis scheme. When the direction information and the sound image localization information of the primary signal indicate different directions, the rendering unit may render the primary signal using a beamforming scheme.

When the direction information and the sound image localization information of the ambient signal indicate the same direction, the rendering unit may render the ambient signal using a wave field synthesis scheme. When the direction information and the sound image localization information of the ambient signal indicate different directions, the rendering unit may render the ambient signal using a beamforming scheme.

The foregoing and/or other aspects are achieved by providing a wave field synthesis and reproduction method including classifying an inputted multi-channel signal into a primary signal and an ambient signal, estimating sound image localization information indicating a localization of the primary signal and sound image localization information indicating a localization of the ambient signal, and rendering the primary signal and the ambient signal based on the sound image localization information of the primary signal, the sound image localization information of the ambient signal, and listener environment information.

According to an embodiment, a distortion with respect to sound field information may be minimized by classifying a multi-channel signal into a primary signal and an ambient signal and reproducing the classified signals.

According to an embodiment, a separate interaction with respect to a corresponding signal may be added by classifying a multi-channel signal into a primary signal and an ambient signal.

Additional aspects of embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
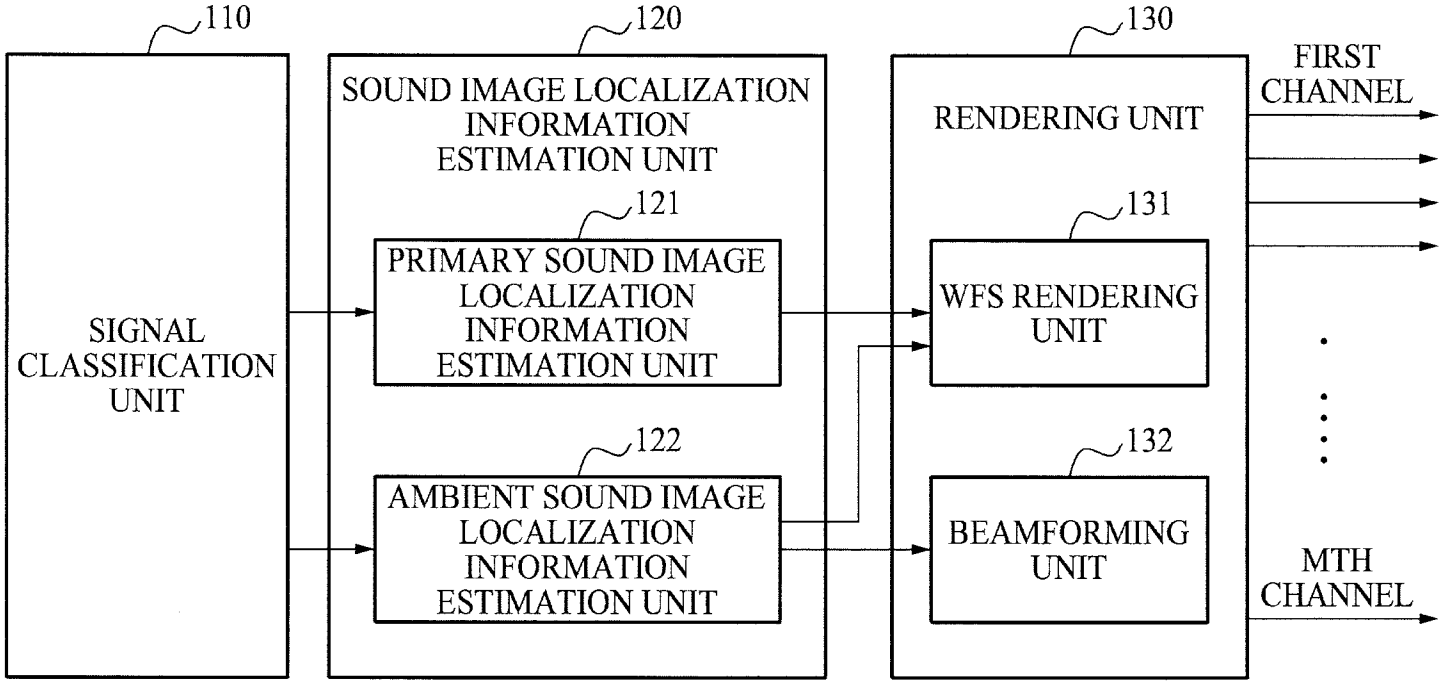
FIG. 1 is a block diagram illustrating a wave field synthesis and reproduction apparatus according to example embodiments.

Reference will now be made in detail to embodiments, examples of which are illustrated in the accompanying drawings, wherein like reference numerals refer to the like elements throughout. Embodiments are described below to explain the present disclosure by referring to the figures. A method of synthesizing and reproducing a wave field may be implemented by a wave field synthesis and reproduction apparatus.

FIG. 1 is a block diagram illustrating a wave field synthesis and reproduction apparatus according to example embodiments.

Referring to FIG. 1, the wave field synthesis and reproduction apparatus according to example embodiments may include a signal classification unit 110, a sound image localization information estimation unit 120, and a rendering unit 130.

The signal classification unit 110 may classify an inputted multi-channel signal into a primary signal and an ambient signal. In this instance, the multi-channel signal may correspond to a discrete multi-channel signal such as a 5.1 channel signal. The signal classification unit 110 may correspond to an upmixer having a configuration of separating the primary signal from the ambient signal. The signal classification unit 110 may separate the primary signal from the ambient signal using one of various algorithms that separate the primary signal from the ambient signal.

An algorithm used for classifying the primary signal and the ambient signal by the signal classification unit 110 may be different from a sound-source separation algorithm which extracts the entire sound source included in an audio signal in that the algorithm separates only a portion of a sound source object from the entire sound source included in the audio signal.

The sound image localization information estimation unit 120 may estimate sound image localization information indicating a localization of the primary signal and the ambient signal classified by the signal classification unit 110.

Referring to FIG. 1, the sound image localization information estimation unit 120 may include a primary signal sound image localization information estimation unit 121 and an ambient signal sound image localization information estimation unit 122. The primary signal sound image localization information estimation unit 121 may estimate the sound image localization information of the primary signal based on localization information of the multi-channel signal and the primary signal. The ambient signal sound image localization information estimation unit 122 may estimate the sound image localization information of the ambient signal based on localization information of the multi-channel signal and the ambient signal. The localization information of the multi-channel signal may include information about a distribution between each channel of the multi-channel signal.

The rendering unit 130 may render the primary signal and the ambient signal based on the sound image localization information of the primary signal, the sound image localization information of the ambient signal, and listener environment information. The listener environment information may correspond to number information indicating a number of speakers reproducing the multi-channel signal, interval information indicating an interval between speakers, and direction information indicating a direction of each speaker. The direction information of each speaker may correspond to information indicating a direction of a disposed speaker array, such as the front, the side, and the rear.

Referring to FIG. 1, the rendering unit 130 may include a wave field synthesis (WFS) rendering unit 131 and a beamforming unit 132. Here, the WFS rendering unit 131 may render the primary signal or the ambient signal using a WFS. The beamforming unit 132 may render the ambient signal using a beamforming scheme.

In particular, when the direction information of the speaker included in the listener environment information and the sound image localization information of the primary signal and the sound image localization information of the ambient signal indicate the same direction, the rendering unit 130 may command the WFS rendering unit 131 to render the primary signal and the ambient signal using the WFS.

Also, when the direction information of the speaker included in the listener environment information and the sound image localization information of the primary signal, or the sound image localization information of the ambient signal indicate different directions, the rendering unit 130 may render the primary signal or the ambient signal indicating a different direction using the beamforming.

Figure 2:
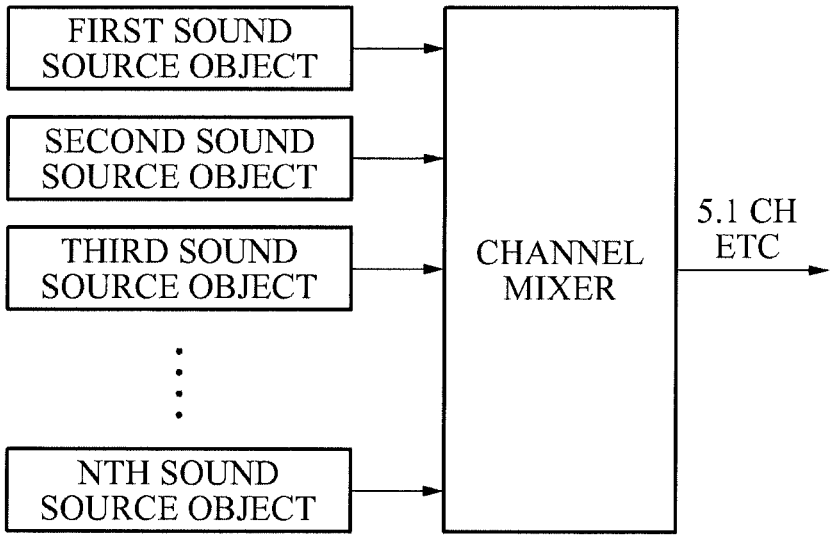
FIG. 2 is a block diagram illustrating an apparatus for generating a multi-channel signal inputted to a wave field synthesis and reproduction apparatus according to example embodiments.

FIG. 2 is a block diagram illustrating an apparatus for generating a multi-channel signal inputted to a wave field synthesis and reproduction apparatus according to example embodiments.

Referring to FIG. 2, the multi-channel signal inputted to the wave field synthesis and reproduction apparatus according to an embodiment may correspond to a signal generated by synthesizing a plurality of sound source objects by using a channel mixer configured by a panning scheme.

Figure 3:
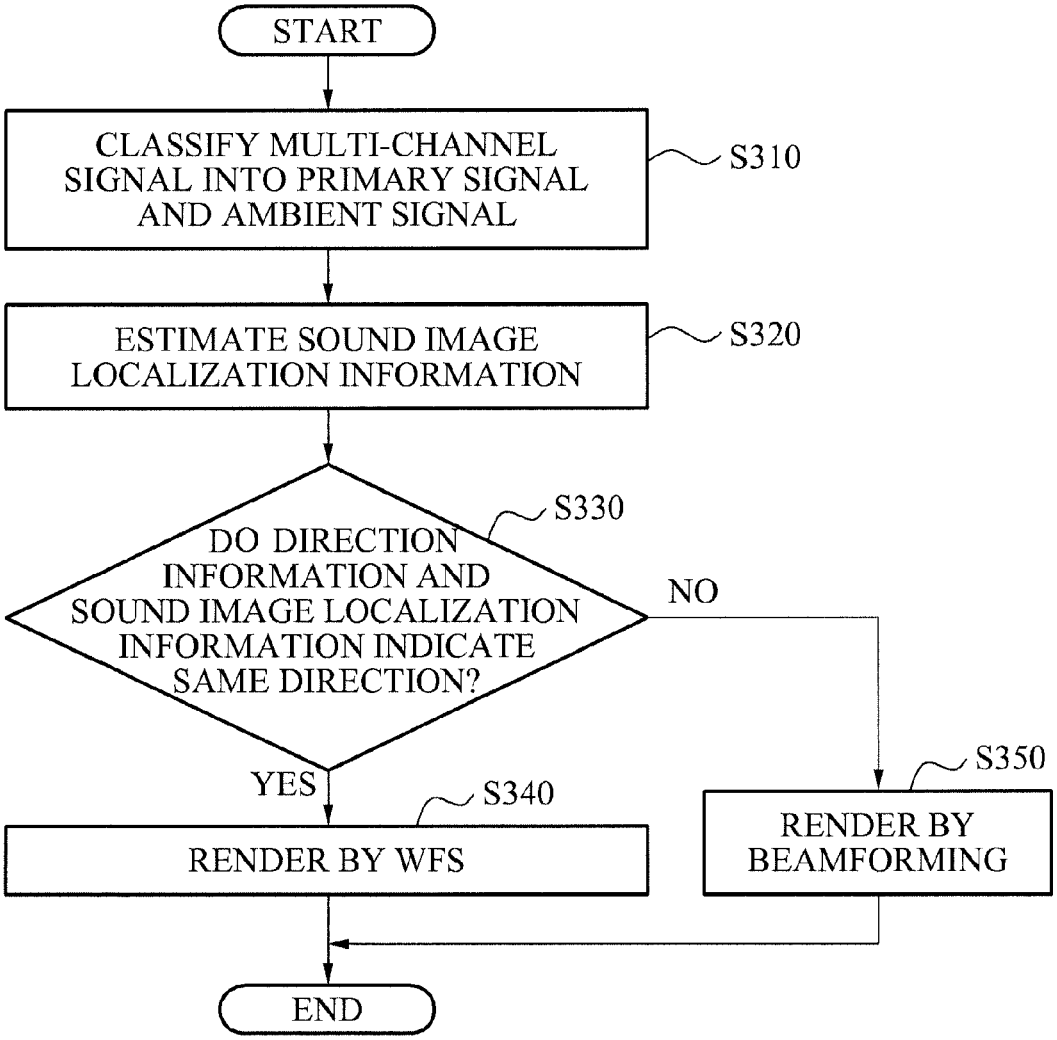
FIG. 3 is a flowchart illustrating a method of synthesizing and reproducing a wave field according to example embodiments.

FIG. 3 is a flowchart illustrating a method of synthesizing and reproducing a wave field according to example embodiments.

In operation S310, the signal classification unit 110 may classify an inputted multi-channel signal into a primary signal and an ambient signal.

In operation S320, the sound image localization information estimation unit 120 may estimate sound image localization information indicating a localization of the primary signal and the ambient signal classified in operation S310. In particular, the primary signal sound image localization information estimation unit 121 may estimate the sound image localization information of the primary signal and the sound image localization information of the ambient signal based on localization information of the multi-channel signal, the primary signal, and the ambient signal.

In operation S330, the rendering unit 130 may receive an input of listener environment information, and the sound image localization information of the primary signal and the sound image localization information of the ambient signal estimated in operation S320, and may verify whether direction information indicating a direction of a speaker included in the listener environment information, the sound image localization information of the primary signal, and the sound image localization information of the ambient signal indicate the same direction.

When the direction information of the speaker and one of the sound image localization information of the primary signal and the sound image localization information of the ambient signal are determined to indicate the same direction in operation S330, the rendering unit 130 may render the primary signal or the ambient signal determined to indicate the same direction as the direction information of the speaker included in the listener environment information using a WFS in operation S340.

Also, when the direction information of the speaker and one of the sound image localization information of the primary signal and the sound image localization information of the ambient signal are determined to indicate different directions in operation S330, the rendering unit 130 may render the primary signal or the ambient signal determined to indicate a different direction using the beamforming in operation S350.

According to an embodiment, a distortion with respect to sound field information may be minimized by classifying a multi-channel signal into a primary signal and an ambient signal and reproducing the classified signals. According to an embodiment, a separate interaction with respect to a corresponding signal may be added by classifying a multi-channel signal into a primary signal and an ambient signal.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An apparatus comprising:

a signal classification unit to classify an inputted multi-channel signal into a primary signal and an ambient signal;

a sound image localization information estimation unit to estimate sound image localization information correspondingly indicating a localization of the primary signal and a localization of the ambient signal; and a rendering unit to render the primary signal and the ambient signal based on a result of direction verification of the sound image localization information corresponding with the primary signal and the ambient signal, relative to a direction indicated in listener environment information.

2. The apparatus of claim 1, wherein the listener environment information comprises number information indicating a number of speakers reproducing the multi-channel signal, interval information indicating an interval between the speakers, and direction information indicating a direction of each speaker.

3. The apparatus of claim 2, wherein, when the direction information and the sound image localization information of the primary signal indicate the same direction, the rendering unit renders the primary signal using a wave field synthesis (WFS) scheme.

4. The apparatus of claim 3, wherein, when the direction information and the sound image localization information of the primary signal indicate different directions, the rendering unit renders the primary signal using a beamforming scheme.

5. The apparatus of claim 2, wherein, when the direction information and the sound image localization information of the ambient signal indicate the same direction, the rendering unit renders the ambient signal using a WFS scheme.

6. The apparatus of claim 5, wherein, when the direction information and the sound image localization information of the ambient signal indicate different directions, the rendering unit renders the ambient signal using a beamforming scheme.

7. The apparatus of claim 1, wherein the sound image localization information estimation unit comprises:

a primary signal sound image localization information estimation unit to estimate the sound image localization information of the primary signal based on localization information of the multi-channel signal and the primary signal; and an ambient signal sound image localization information estimation unit to estimate the sound image localization information of the ambient signal based on localization information of the multi-channel signal and the ambient signal.

8. The apparatus of claim 1, wherein, by using a channel mixer configured by a panning scheme, the multi-channel signal is generated by synthesizing a plurality of sound source objects.

9. The apparatus of claim 1, wherein the signal classification unit corresponds to an upmixer having a predetermined configuration.

10. A method comprising:

classifying an inputted multi-channel signal into a primary signal and an ambient signal;

estimating sound image localization information correspondingly indicating a localization of the primary signal and a localization of the ambient signal; and rendering the primary signal and the ambient signal based on a result of direction verification of the sound image localization information corresponding with the primary signal and the ambient signal, relative to a direction indicated in listener environment information.

11. The method of claim 10, wherein the listener environment information includes number information indicating a number of speakers reproducing the multi-channel signal, interval information indicating an interval between speakers, and direction information indicating a direction of each speaker.

12. The method of claim 11, wherein, when the direction information and the sound image localization information of the primary signal indicate the same direction, the rendering comprises rendering the primary signal using a wave field synthesis (WFS) scheme.

13. The method of claim 12, wherein, when the direction information and the sound image localization information of the primary signal indicate different directions, the rendering comprises rendering the primary signal using a beamforming scheme.

14. The method of claim 11, wherein, when the direction information and the sound image localization information of the ambient signal indicate the same direction, the rendering comprises rendering the ambient signal using a WFS scheme.

15. The method of claim 14, wherein, when the direction information and the sound image localization information of the ambient signal indicate different directions, the rendering comprises rendering the ambient signal using a beamforming scheme.

16. The method of claim 10, wherein the estimating comprises:

estimating the sound image localization information of the primary signal based on localization information of the multi-channel signal and the primary signal; and estimating the sound image localization information of the ambient signal based on localization information of the multi-channel signal and the ambient signal.

17. The method of claim 10, wherein, by using a channel mixer configured by a panning scheme, the multi-channel signal is generated by synthesizing a plurality of sound source objects.

* * * * *